United States Patent [19]

Jost et al.

[11] Patent Number: 4,700,475

[45] Date of Patent: Oct. 20, 1987

[54] METHOD OF MAKING ELECTRICAL CONTACTS

[75] Inventors: Ernest M. Jost, Plainville; Timo J. Santala, North Attleboro, both of Mass.

[73] Assignee: Chemet Corporation, Attleboro, Mass.

[21] Appl. No.: 834,620

[22] Filed: Feb. 28, 1986

[51] Int. Cl.[4] ..... H01R 43/16

[52] U.S. Cl. ..... 29/874; 200/260

[58] Field of Search ..... 29/874; 148/11.5 R, 148/11.5 N; 200/265, 266, 267, 268; 428/929

[56] References Cited

U.S. PATENT DOCUMENTS

| | | | |
|---|---|---|---|
| 3,258,829 | 7/1966 | Gwyn Jr. | 200/266 X |
| 3,596,030 | 7/1971 | Shibata | 200/266 |
| 3,688,067 | 8/1972 | Shibata . | |
| 3,807,994 | 4/1974 | Jost | 428/929 X |
| 3,814,640 | 6/1974 | Shibata | 29/874 X |
| 4,112,197 | 9/1978 | Metz | 29/874 X |

FOREIGN PATENT DOCUMENTS

| | | | |
|---|---|---|---|
| 39-20326 | 9/1964 | Japan | 200/266 |

*Primary Examiner*—P. W. Echols
*Assistant Examiner*—Carl J. Arbes

[57] ABSTRACT

Electrical contacts of silver-cadmium alloy or other silver alloys suitable for I/O in which the cadmium is oxidized adjacent one side only are made providing a tube of silver-cadmium alloy, coating the inner wall with a layer of parting compound or inserting in the tube a sheet separator coated on each face with a layer of parting compound, compressing the tube to flatten it, heating the flattened tube in an oxygen-containing atmosphere to oxidize the cadmium content adjacent the outer face of the tube and to leave it unoxidized the cadmium content adjacent the inner face, and removing the layer of parting compound and cutting the wall of the flattened tube into individual contacts.

10 Claims, No Drawings

METHOD OF MAKING ELECTRICAL CONTACTS

This invention relates to a method of making silver-cadmium alloy electrical contacts having the cadmium content adjacent one face oxidized while leaving unoxidized the cadmium content adjacent the opposing face.

Silver-cadmium alloy electrical contacts are conventionally subjected to internal oxidation by heating a sheet or strip of the contact material of the desired thickness in an oxygen-containing atmosphere, oxidation of the cadmium content of the material progressing inwardly from the exposed surfaces. The sheet or strip is then cut into individual contact elements of the desired size. Such contacts suffer from two major drawbacks. First, since the cadmium migrates or diffuses toward the surface of the material during the process of internal oxidation, the center zone of the internally oxidized material lacks the desired concentration of cadmium oxide particles. Consequently, after the contact has eroded during use to approximately one-half of its original thickness, it loses the non-welding characteristics provided by cadmium oxide. Secondly, such a contact cannot be soldered or brazed to the contact blade material (usually copper alloys), but requires a backing, usually of silver alone, which must be attached in a separate bonding step which increases the cost and provides a possible source of failure.

It has previously been proposed as described in Shibata U.S. Pat. No. 3,688,067 to apply an antioxidant layer of another metal such as nickel to one face of the silver-cadmium alloy contact material before subjecting it to internal oxidation, and subsequently to remove the anti-oxidant layer. It has also been proposed in the same patent to mate two pieces of silver-cadmium alloy together and weld them at their mated faces into a single plate before subjecting to internal oxidation, followed by separation into two pieces after oxidation, then cutting individual contacts from the pieces. In the alternative it is proposed in the patent to subject to internal oxidation a piece of silver cadmium alloy contact material twice as thick as the desired contact, then cut it in half after internal oxidation, each half being cut into individual contacts.

It has also been proposed in Jost U.S. Pat. No. 3,807,994 to pressure-bond a strip of silver-cadmium alloy contact material to a thin layer of silver or to layers of silver-cadmium alloy of varying cadmium content before internal oxidation.

The present invention provides a simplified method of making silver-cadmium alloy electrical contacts in which the cadmium content is oxidized adjacent one side only of the contact, which method comprises providing a tube of silver-cadmium alloy, providing at least one layer of parting compound within said tube, compressing the tube to flatten it and force its inner face into close contact with said layer heating said flattened tube in an oxygen-containing atmosphere to effect oxidation of the cadmium content of said alloy adjacent the outer surface of said flattened tube and to leave substantially unoxidized the cadmium content of said alloy adjacent the inner face of said flattened tube, and removing said layer of parting compound and cutting the wall of said tube into individual electrical contacts.

The silver-cadmium alloy employed in the tube of the present invention can be any of those commonly used for making silver-cadmium oxide electrical contacts and may contain 5 to 20% cadmium by weight. The tube of alloy may be formed in any conventional manner such as by casting or extruding the alloy to form a tube of the desired wall thickness, usually from 2–7 mm in thickness. The tube may have any desired or convenient overall cross-sectional shape, e.g. circular, oval, rectangular, etc., and any desired or convenient overall diameter usually from 5 to 250 mm. Once formed, the inner face of the wall of the tube can be coated with a conventional parting compound in finely-divided particulate form by injecting into the interior of the tube through an open end a suspension in aqueous or other fluid medium of particulate solid such as magnesium oxide or other suitable metal oxide, talc, graphite or other material which is chemically inert to the silver cadmium alloy and which does not melt or become alloyed with the silver-cadmium alloy at temperatures required for the subsequent internal oxidation step, following which excess suspension is removed and the coating dried, if desired. Instead of providing the parting compound in the form of a coating or layer of finely-divided particles on the inner face of the tubing wall, it may provided in the form of a coating or layer on the surface of a removable support adapted to be inserted into the tube. For example, a flat sheet of carbon steel bearing on its surfaces a layer or coating of iron oxide may be inserted within the tube before flattening, the iron oxide coating serving as a parting compound to prevent cold welding of the inner faces of the flattened tube with each other during compression as well as preventing cold welding or alloying of the tube wall with the steel support. A suitable layer of iron oxide can be provided simply by heating in air a sheet of carbon steel, the sheet having dimensions appropriate to the size of the tube; for example, in the case of a rectangular tube with inner dimensions prior to flattening of $4.5\times0.25$ inches, a steel sheet $4.25\times0.05$ inches can be used. The thickness of the iron oxide layer or of the coating or layer of particulate parting compound on the inner face of the tube wall is not critical so long as it effectively prevents alloying or cold welding of the metal of the tube with itself or with the steel support, when the latter is used, during the compression and subsequent heating of the flattened tube. In the case of a steel sheet support having a coating of iron oxide, the coating is desirably one mil or more in thickness.

Following the step of providing a layer of parting compound within the tube, the latter is flattened by compression, for example by a cold rolling process in which the tube is passed between a pair or series of pairs of pressure rollers at approximately room temperature. This operation brings the inner wall of the tube into close contact either with itself or with the surfaces of the steel support member inserted within it, the coating or layer of parting compound being interposed between the surfaces in each case. The two layers of parting compound on opposite faces of the sheet support member perform the same function as the single layer of parting compound on the inner face of the tube wall. This compressing step involves reducing the wall thickness of the tube by 25% or more to approximately 1 to 4 mm, approximately the same thickness as desired in the finished electrical contact.

The flattened tube is then heated in an oxygen-containing atmosphere, for example, air or pure oxygen, at a temperature and for a time sufficient to effect oxidation of the cadmium content of the alloy adjacent the outer surface of the flattened tube while leaving unoxidized the cadmium content of the alloy adjacent the inner face or surface of the flattened tube.

Because of the close contact of the inner faces of the flattened tube with each other or with the surfaces of the steel support member insert, little or no oxidation of cadmium adjacent the inner faces occurs. Although it is ordinarily unnecessary, it is also possible to omit the layer of parting compound from the zones adjacent the ends of the tube so that these zones are cold welded to form a hermetic seal during the compressing step.

Oxidation proceeds inwardly from the outer surface of the tube, and the approximate depth to which oxidation extends can be calculated from the following equation in which X=depth of penetration of the oxidation front, in mm; e is the base for natural logarithms; T is the temperature in degrees K; P is partial pressure of oxygen in mm of mercury; t is time in hours and Cdc is the cadmium concentration of the alloy in atomic percent:

$$X^2 = \frac{11.6e^{-\frac{12200}{T}} \sqrt{P}\, t}{Cdc}$$

The extent of penetration of the internal oxidation is not critical but may vary from about 60 to 90% of the wall thickness of the flattened tube, preferably from about 75 to 85%. As an example, in the case of a flattened tube having a wall thickness of 1.5 mm, a cadmium concentration of 13 atomic percent, using pure oxygen and heating at 880° C., approximately 23 hours is required to achieve a penetration of 80% of the wall thickness.

After the internal oxidation has been carried out to the desired extent, the flattened tube is removed from the oxidizing furnace, and is then opened by slitting or cutting it, the support member, if present, is removed, and the coating of parting compound is removed if necessary from the inner wall surface of the tube by washing or brushing. In order to ensure complete removal of the parting compound, particularly when a coating iron oxide is employed as the parting compound on a steel support member, it is preferred to subject the opened tube to electrolytic pickling or cleaning. The flattened wall may be subjected to an additional rolling step following removal of the parting compound or separator in order to provide a smooth finish if desired; such an additional rolling step results in further reduction in the thickness of the material. Individual electrical contacts are then die-cut or otherwise severed from the flattened wall.

If desired, the oxidized flattened tube may be die-cut into individual electrical contacts, two at a time, without opening the tube; the two contacts can then be separated and the coating of parting compound or the separator sheet on the inner unoxidized sides can be removed, by cleaning.

The electrical contacts made by the method of the present invention are free from an interior zone in which the cadmium oxide is depleted, hence they display the superior non-fusing characteristics of silver-cadmium oxide alloys during use of the contacts until they are eroded to the level of the unoxidized alloy layer employed for brazing or soldering them to the contact blade material. Moreover, by the method of the present invention, the thickness of the unoxidized alloy layer can be controlled to the minimum thickness required for the brazing or soldering operation, thus reducing cost.

What is claimed is:

1. The method of making silver-cadmium alloy electrical contacts in which the cadmium content is oxidized adjacent one side only of the contact which comprises providing a tube of silver-cadmium alloy providing at least one layer of parting compound within said tube, compressing said tube to flatten it and force its inner face into close contact with said layer, heating said flattened sealed tube in an oxygen-containing atmosphere to effect oxidation of the cadmium content of said alloy adjacent the outer surface of said flattened tube and to leave substantially unoxidized the cadmium content of said alloy adjacent the inner surface of said tube, and removing said layer of parting compound and cutting the wall of said flattened tube into individual electrical contacts.

2. The method as claimed in claim 1 in which said tube has an initial wall thickness of 2 to 7 mm and said compressing step reduces the initial wall thickness to 2 to 4 mm.

3. The method as claimed in claim 1 in which the oxidation extends to a depth of 60 to 90% of the wall thickness of said flattened tube.

4. The method as claimed in claim 1, 2 or 3 in which said layer of parting compound is provided as a coating on a support member and said coated support member is inserted within said tube.

5. The method as claimed in claim 1, 2 or 3 in which said layer of parting compound comprises a coating of iron oxide on both faces of a sheet steel support member, and said coated support member is inserted within said tube.

6. The method as claimed in claim 1, 2 or 3 in which said layer of parting compound is provided as a coating of particles on the inner face of the tube.

7. The method as claimed in claim 1 in which said removal of parting compound is carried out before cutting into individual contacts.

8. The method as claimed in claim 1 in which said removal of parting compound is carried out after cutting into individual contacts.

9. The method as claimed in claims 1, 2 or 3 in which the step of removing parting compound comprises electrolytic pickling.

10. The method as claimed in claim 1 in which the ends of said tube are hermetically sealed in said compressing step.

* * * * *